US012075851B2

(12) United States Patent
Ando et al.

(10) Patent No.: US 12,075,851 B2
(45) Date of Patent: Sep. 3, 2024

(54) GARMENT

(71) Applicants: TORAY INDUSTRIES, INC., Tokyo (JP); Toray Industries (H.K.) Ltd., Hong Kong (CN)

(72) Inventors: Daichi Ando, Osaka (JP); Takamitsu Taniguchi, Osaka (JP); Masanori Sugino, Osaka (JP); Hirotaka Itou, Osaka (JP); Shingo Matsumoto, Hong Kong (CN); Azuki Otsuka, Hong Kong (CN)

(73) Assignees: TORAY INDUSTRIES, INC., Tokyo (JP); TORAY INDUSTRIES (H.K.) LTD., Hong Kong (CN)

( * ) Notice: Subject to any disclaimer, the term of this patent is extended or adjusted under 35 U.S.C. 154(b) by 0 days.

(21) Appl. No.: 17/632,672

(22) PCT Filed: Aug. 4, 2020

(86) PCT No.: PCT/JP2020/029838
§ 371 (c)(1),
(2) Date: Feb. 3, 2022

(87) PCT Pub. No.: WO2021/025021
PCT Pub. Date: Feb. 11, 2021

(65) Prior Publication Data

US 2022/0279862 A1 Sep. 8, 2022

(30) Foreign Application Priority Data

Aug. 5, 2019 (JP) ..... 2019-144059

(51) Int. Cl.
*A41B 9/06* (2006.01)
*A41D 27/00* (2006.01)
*A41D 27/24* (2006.01)

(52) U.S. Cl.
CPC ..... *A41B 9/06* (2013.01); *A41D 27/00* (2013.01); *A41D 27/245* (2013.01)

(58) Field of Classification Search
CPC ..... A41B 9/06; A41B 2300/52; A41B 1/00; A41D 27/00; A41D 27/245; A41D 2300/52; A41D 1/04
See application file for complete search history.

(56) References Cited

U.S. PATENT DOCUMENTS 3,873,999 A * 4/1975 Artzt ..... A41B 9/06 2/113
4,214,319 A 7/1980 Bollag
(Continued)

FOREIGN PATENT DOCUMENTS

CN 104413823 A 3/2015
CN 107125814 A 9/2017
(Continued)

OTHER PUBLICATIONS

Nomura et al., "Clothing" (translation), 2016, Clarivate Analytics (Year: 2016).*
(Continued)

*Primary Examiner* — Katherine M Moran
*Assistant Examiner* — Haley A Smith
(74) *Attorney, Agent, or Firm* — Birch, Stewart, Kolasch & Birch, LLP

(57) ABSTRACT

Provided is a garment made of a stretchable fabric and having an opening. The opening has a structure in which a fabric edge is folded back, and the fabric edge is fastened to a main body of the fabric with adhesives, a part of the opening is formed with a pattern in which curvature of the opening changes, and a row of the adhesives that are applied on a side closest to the edge of the fabric is applied within 2 mm from the edge of the fabric, and a difference between
(Continued)

an average of spacings between adjacent adhesives applied in a row in a 3-cm section of a portion having the largest curvature radius at the opening and an average of spacings between adjacent adhesives applied in a row in a 3-cm section of a portion having a smaller curvature radius at the opening is within 15%.

5 Claims, 5 Drawing Sheets

(56) References Cited

U.S. PATENT DOCUMENTS

| | | | |
|---|---|---|---|
| 2009/0049576 | A1 | 2/2009 | Toratani |
| 2013/0007947 | A1 | 1/2013 | Moore et al. |
| 2019/0350282 | A1 * | 11/2019 | Du ..... B29C 66/729 |

FOREIGN PATENT DOCUMENTS

| | | | | |
|---|---|---|---|---|
| CN | 109674124 | A | | 4/2019 |
| JP | 54-63951 | A | | 5/1979 |
| JP | 2005-264394 | A | | 9/2005 |
| JP | WO2007/086110 | A1 | | 8/2007 |
| JP | 2015-212428 | A | | 11/2015 |
| JP | 2016-74996 | A | | 5/2016 |
| JP | 2016074996 | A | * | 5/2016 |
| JP | 2017-222969 | A | | 12/2017 |
| JP | 6249821 | B2 | | 12/2017 |
| KR | 101810927 | B1 | * | 12/2017 |
| WO | WO 2018/120205 | A1 | | 7/2018 |
| WO | WO-2020243923 | A1 | * | 12/2020 |

OTHER PUBLICATIONS

Cha, Jin Seoup, Hot-Melt Sticking Film for Seamless and Clothes Manufacture Method Usiing It (translation), 2017, Clarivate Analytics (Year: 2017).*

International Search Report, issued in PCT/JP2020/029838, PCT/ISA/210, dated Nov. 2, 2020.

Written Opinion of the International Searching Authority, issued in PCT/JP2020/029838, PCT/ISA/237, dated Nov. 2, 2020.

Chinese Office Action and Search Report for Chinese Application No. 202080055806.4 dated Jun. 21, 2023.

Extended European Search Report for European Application No. 20850819.2, dated Jul. 3, 2023.

Taiwanese Office Action and Search Report dated Aug. 25, 2023 for Application No. 109126520.

Chinese Office Action and Search Report for Chinese Application No. 202080055806.4, dated Feb. 5, 2024, with English translation.

* cited by examiner (a)

(b)

GARMENT

FIELD

The present invention relates to a garment.

BACKGROUND

Conventionally, as a technique to process an edge of a fabric forming a garment at an opening of the garment, a technique to bond together and fasten the edge of the fabric, which is folded over, with an adhesive tape is known. For example, in Patent Literature 1, a related technique is proposed in which, when an outer fabric is folded back for a hem of a swimsuit, for example, the hem is formed by bonding with a hot-melt sheet.

Meanwhile, as a technique to join a plurality of fabrics forming a garment to each other, a technique to join the fabrics forming the garment to each other with an adhesive that is applied in a dot pattern is known. For example, in Patent Literature 2, a technique is proposed in which, when the body and sleeves of an undershirt are joined, they are bonded together with an adhesive that is repeatedly applied in a dot pattern.

CITATION LIST

Patent Literature

Patent Literature 1: Japanese Patent Application Laid-open No. 2005-264394

Patent Literature 2: Japanese Patent No. 6249821

SUMMARY

Technical Problem

However, for example, when an edge of a fabric forming a garment at an opening of the garment is folded back and joined with an adhesive that is applied in a dot pattern, in a portion of a folded-back fabric edge that is curved in a concave shape and has a smaller curvature radius, a side closer to the fabric edge is stretched and widened due to the difference between its inner and outer circumferences, whereby the spacing between adjacent adhesives is widened. When the spacing between the adhesives has been widened, the appearance thereof becomes different from that of a portion curved in a concave shape and having a larger curvature radius, and also there is a problem in that the adhesive strength per unit width decreases. Furthermore, in the portion of the fabric edge at an opening curved in a concave shape and having a smaller curvature radius, there is a problem in that bonded portions are more likely to peel off than the portion that has a larger curvature radius because the side closer to the fabric edge is stretched and widened whereby the tensile stress increases therein.

The present invention has been made in view of the foregoing, and it is an object thereof to provide a garment with which, even when a fabric edge that is curved in a concave shape at an opening and has portions having different curvature radii is folded over and is fastened with dotted adhesives, reduction in adhesive strength can be prevented and poor appearance can be mitigated.

Solution to Problem

To solve the problem described above and to achieve the object, a garment according to the present invention is a garment made of a stretchable fabric and having an opening through which a body part of a wearer is passed. The opening has a structure in which a fabric edge is folded back, and the fabric edge is fastened to a main body of the fabric with dotted adhesives that are applied in a single row or multiple rows along the fabric edge, a part of the opening is formed with a pattern in which curvature of the opening changes, and a row of the adhesives that are applied on a side closest to the edge of the fabric is applied within 2 mm from the edge of the fabric, and a difference between an average of spacings between adjacent adhesives applied in a row in a 3-cm section of a portion having the largest curvature radius at the opening and an average of spacings between adjacent adhesives applied in a row in a 3-cm section of a portion having a smaller curvature radius at the opening is within 15%.

In the garment according to the present invention, a folded width of the fabric edge is 2 to 25 mm.

In the garment according to the present invention, a row of the adhesives on a side closest to a fold line is applied at a spacing of 0.5 mm or more away from the fold line.

In the garment according to the present invention, the adhesives are a reactive hot-melt adhesive.

Advantageous Effects of Invention

According to the present invention, when the fabric edge having such a pattern that the curvature radius of the concave shape at the opening changes is folded over and fastened with an adhesive that is arranged in a dot pattern, poor appearance of this portion and reduction in adhesive strength can be mitigated.

DESCRIPTION OF EMBODIMENTS

Modes for embodying the present invention (hereinafter, called "embodiments") will now be described with reference to the attached drawings. Herein, the drawings are merely schematic ones.

First Embodiment

Figure 1:
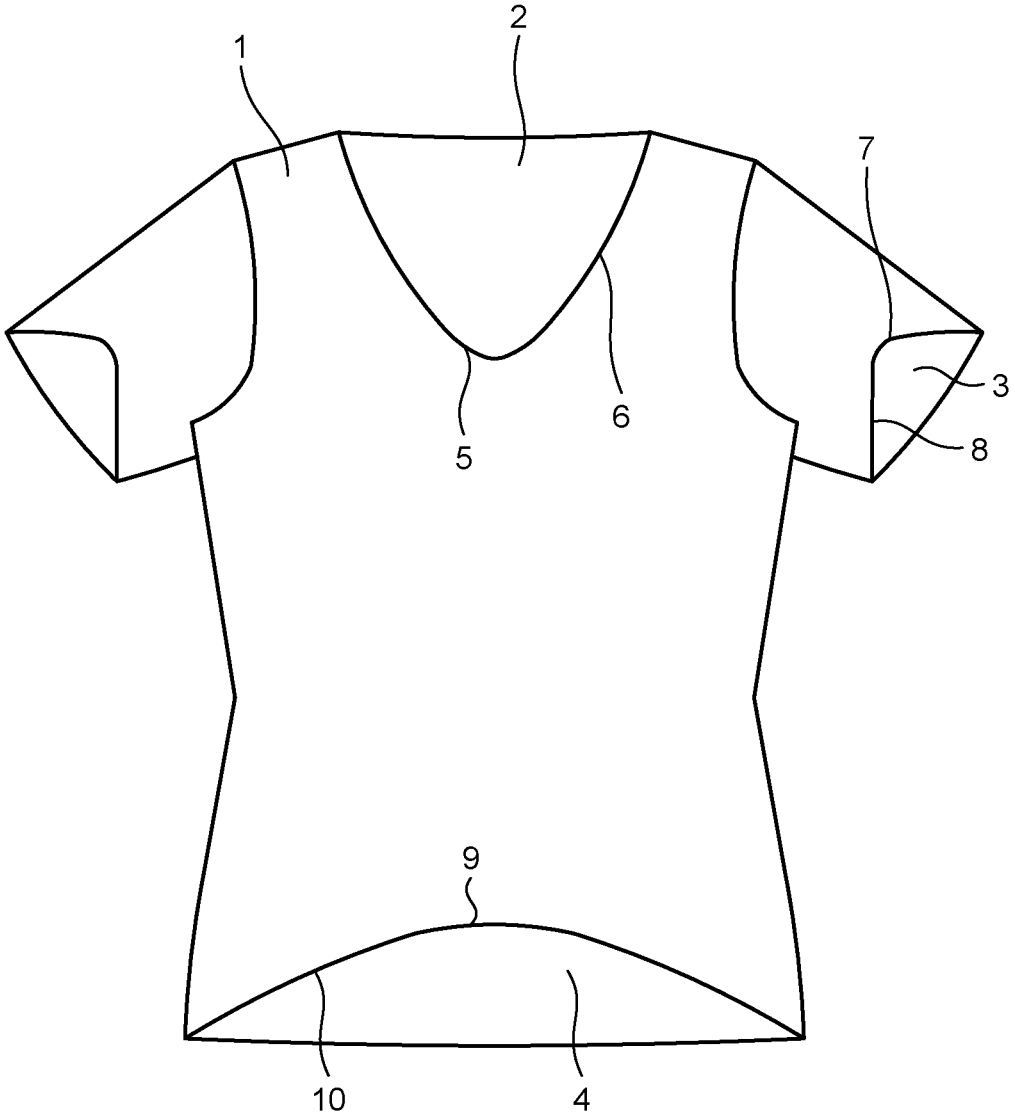
FIG. 1 is a diagram illustrating an appearance of a garment according to a first embodiment.

FIG. 1 is a diagram illustrating a configuration of a garment according to a first embodiment. The garment 1 illustrated in this diagram is one example of upper wear of short-sleeved underwear, and has openings 2, 3, and 4 through which a head, arms, and a torso are passed. The openings 2, 3, and 4 are formed in such patterns that their curvatures change, and respectively have portions 5, 7, and 9 curved in a concave shape and having the smallest curvature radii and portions 6, 8, and 10 curved in a concave shape and having the largest curvature radii. Herein, in order to describe features of the invention, the portions 5, 7, and 9 of the openings 2, 3, and 4 curved in a concave shape and having the smallest curvature radii and the portions 6, 8, and 10 curved in a concave shape and having the largest curvature radii are mainly described. However, in addition to the portions 5, 7, and 9 curved in a concave shape and having the smallest curvature radii and the portions 6, 8, and 10 curved in a concave shape and having the largest curvature radii, the openings 2, 3, and 4 also have portions having curvature radii that are intermediate between each of the portions 5, 7, and 9 curved in a concave shape and having the smallest curvature radii and the corresponding one of the portions 6, 8, and 10 curved in a concave shape and having the largest curvature radii.

The garment 1 is made of a stretchable fabric. For example, a circular-knitted or warp-knitted material has stretchability required for accomplishing the present invention if it is a knitted material provided as a general clothing material, and is not limited to a particular one. A material having stretchability for clothing is suitable for the present invention even if it is a woven material. It can be used as a material for general underwear and inner wear with cups, and also for outerwear such as T-shirts and cut-and-sew clothes, and the use thereof is not limited to a particular one.

Figure 2:
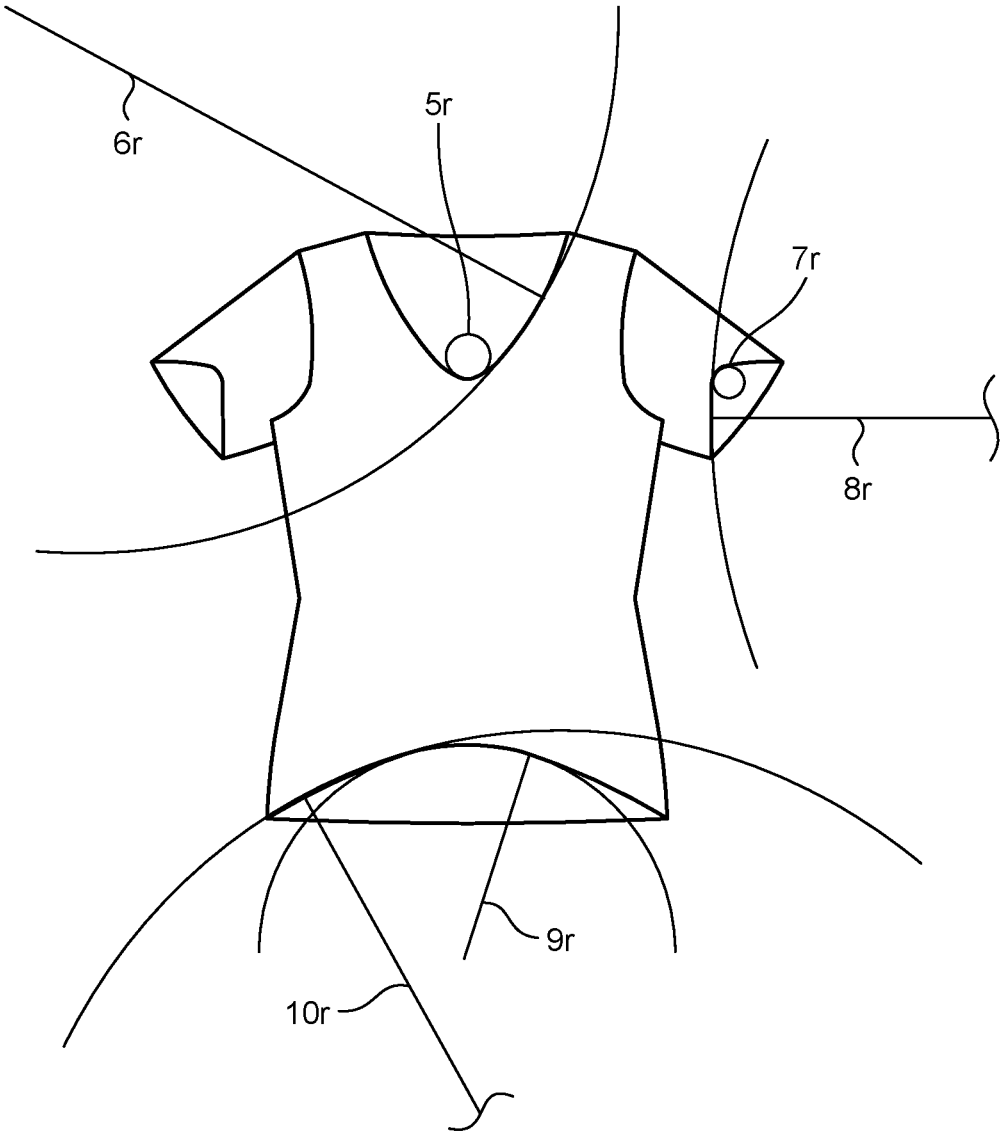
FIG. 2 is a diagram illustrating curvature radii at openings of the garment illustrated in FIG. 1.

FIG. 2 is a diagram indicating, at the openings 2, 3, and 4 of the garment 1, curvature radii 5*r*, 7*r*, and 9*r* of the portions 5, 7, and 9 curved in a concave shape and having the smallest curvature radii and curvature radii 6*r*, 8*r*, and 10*r* of the portions 6, 8, and 10 curved in a concave shape and having the largest curvature radii. In this case, 5*r* is 2 cm, 6*r* is 60 cm, 7*r* is 1.5 cm, 8*r* is 70 cm, 9*r* is 13 cm, and 10*r* is 70 cm, for example.

The curvature radii herein are curvature radii that are radii of circles substantially corresponding to curves that form the respective shapes of the openings 2, 3, and 4 of the garment 1 in each section of 3 cm. The curves that form the shapes of the openings 2, 3, and 4 of the garment 1 are considered separately for each fabric that forms the garment 1. Specifically, if the opening 2 through which the head is passed is divided into front and back bodies, these respective bodies are considered separately.

Figure 3:
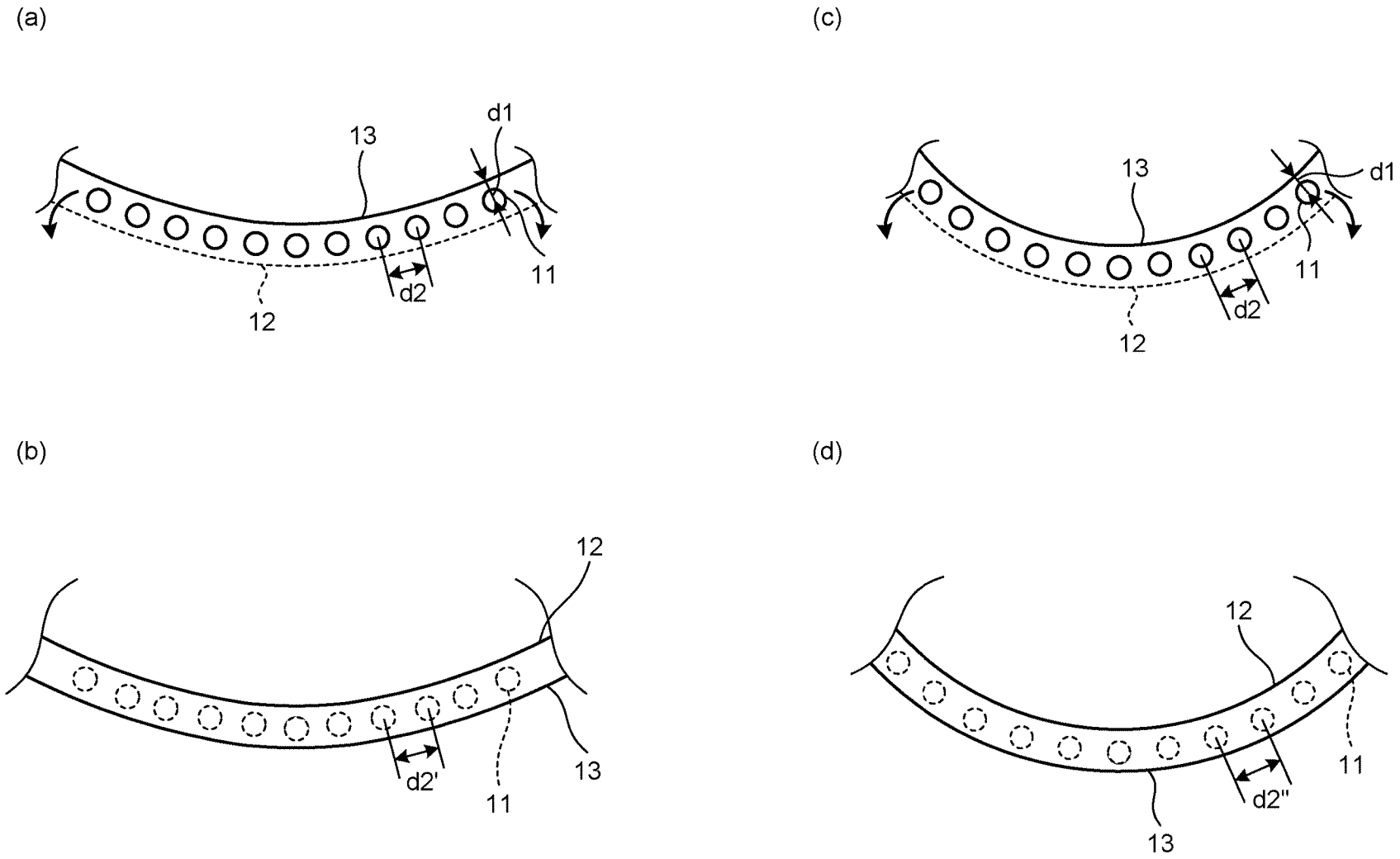
FIG. 3 includes diagrams schematically illustrating states in which adhesives are applied at openings of the garment illustrated in FIG. 1.

FIG. 3(*a*) is a diagram illustrating one example of a positional relation between a fabric edge of a portion having a larger curvature radius at an opening of the garment 1 and adhesives applied thereto in a single row. FIG. 3(*b*) is a diagram illustrating a positional relation between the fabric edge and the adhesives when the fabric edge has been folded back along a fold line at the opening of FIG. 3(*a*). FIG. 3(*c*) is a diagram illustrating one example of a positional relation between a fabric edge of a portion having a smaller curvature radius at the opening of the garment 1 and adhesives applied thereto in a single row. FIG. 3(*d*) is a diagram illustrating a positional relation between the fabric edge and the adhesives when the fabric edge has been folded back along a fold line at the opening of FIG. 3(*c*).

As illustrated in FIGS. 3(*a*) and (*c*), dotted adhesives 11 are arranged in a single row along the edge 13 of the fabric curved in a concave shape. If the distance d1 between the edge 13 of the fabric and the row of the adhesives 11 increases, the edge 13 of the fabric becomes a free end and a problem of bending backward is more likely occur when the edge 13 of the fabric has been folded back along the fold line 12. Thus, it is important that the distance d1 between the edge 13 of the fabric and the row of the adhesives 11 is set within 2 mm, and is preferably set within 1 mm. Herein, the adhesives 11 are arranged on the side closer to the fabric edge relative to the fold line 12, but can be arranged also on the side closer to the main body of the fabric relative to the fold line 12. However, when the adhesives 11 are arranged on the side closer to the main body of the fabric relative to the fold line 12 and the folded width of the fabric edge is reduced, there is a risk that the fabric edge and the main body of the fabric cannot be reliably bonded to each other with the adhesives 11, depending on the precision in the arrangement of the adhesives 11 or the precision in the width of the folded fabric edge. Thus, the adhesives 11 are preferably arranged on the side closer to the fabric edge relative to the fold line 12.

When the edge 13 of the fabric has been folded back along the fold line 12, the fabric edge on which the adhesives 11 are arranged is stretched and widened due to the difference between its inner and outer circumferences, and the spacings d2' and d2" between the adhesives 11 accordingly become wider than the spacing d2 when the adhesives 11 were applied. As illustrated in FIGS. 3(*b*) and (*d*), when the adhesives 11 are arranged at the same spacings d2 on the fabric edge of the portion having a larger curvature radius and on the fabric edge of the portion having a smaller curvature radius and the edge 13 of the fabric is folded back along the fold line 12, the spacing d2" between the adhesives 11 on the fabric edge of the portion having a smaller curvature radius becomes larger than the spacing d2' between the adhesives 11 on the fabric edge of the portion having a larger curvature radius. It was found that, when the difference between the spacings d2' and d2" between the adhesives 11 is excessively large, the appearance becomes poor and the adhesive strength decreases. Specifically, in the garment 1 according to the present invention, it is important that, at each of the openings 2, 3, and 4 of the garment 1, a difference between an average of spacings between adjacent dotted adhesives 11 applied in a 3-cm section of a portion having the largest curvature radius and an average of spacings between adjacent dotted adhesives 11 applied in a 3-cm section of a portion having a smaller curvature radius is set within 15%. By this setting, even if the curvature radius of the curve of the concave shape changes, the spacings between the adhesives 11 are similar to each other, and thus the adhesive strength per unit width can be set substantially uniform and the poor appearance can be mitigated. More preferably, at each of the openings 2, 3, and 4, the difference between the average of the spacings between adjacent dotted adhesives 11 applied in the 3-cm section of the portion having the largest curvature radius and the average of the spacings between adjacent dotted adhesives 11 applied in the 3-cm section of the portion having a smaller curvature radius is within 13%. Herein, the portion having a smaller curvature radius is a portion the curvature radius of which is smaller than that of the portion having the largest curvature radius, and means all portions other than the portion having the largest curvature radius. Furthermore, the curvature radius at each opening herein is the curvature radius of an outer peripheral curve of each of the openings 2, 3, and 4 of the garment 1 according to the present invention.

At each of the openings 2, 3, and 4 of the garment 1, in order to set the difference between the average of the spacings between adjacent dotted adhesives 11 applied in the 3-cm section of the portion having the largest curvature radius and the average of the spacings between adjacent dotted adhesives 11 applied in the 3-cm section of the portion having a smaller curvature radius within 15%, it is important to apply the adhesives 11 at dot spacings that are predetermined to be necessary in consideration of widening of dot spacing, which are estimated based on the relation between the size of curvature radius drawn by the row of the dotted adhesives 11 and the folded width to be folded back. In other words, it is important to change the spacing between the dotted adhesives 11 in accordance with the curvature radius of the pattern of each of the openings 2, 3, and 4 of the garment 1.

The 3-cm section of the portion having the largest curvature radius at each of the openings 2, 3, and 4 of the garment 1 means a range of 1.5 cm on both sides of the point of contact with a circle the curvature radius of which is substantially the same as that of the portion having the largest curvature radius. The same applies to the portion having a smaller curvature radius.

The portion having the largest curvature radius at each of the openings 2, 3, and 4 of the garment 1 may be formed in a pattern that is infinitely close to a straight line under certain circumstances.

The edge 13 of the fabric, which forms each of the openings 2, 3, and 4 of the garment 1, may be in such a state that the fabric has been just cut and left raw, may be hemmed by overlocking or be piped with a tape-type sewing material, or is not limited to a particular one as long as the fabric edge can be folded back even if it has been cut by heat cutting or a laser and left raw. However, for the fabric edge to be folded back, it is preferable that the stretch property of the fabric be not impaired by them.

In the garment 1 according to the present invention, at each of the openings 2, 3, and 4, the difference between the average of the spacings between adjacent adhesives 11 applied in a row in the 3-cm section of the portion having the largest curvature radius and the average of the spacings between adjacent adhesives 11 applied in a row in the 3-cm section of the portion having a smaller curvature radius is within 15%. The difference between the average of the spacings between adjacent adhesives 11 in the portion having the largest curvature radius and the average of the spacings between adjacent adhesives 11 in the portion having a smaller curvature radius can be calculated by the following formulas.

$$\text{Difference between averages of spacings of adhesives} = [(ds-db)/db] \times 100$$

ds: the average of spacings between the adhesives in the portion having a smaller curvature radius db: the average of spacings between the adhesives in the portion having the largest curvature radius A case in which the value of [(ds−db)/db] is negative is included.

For example, a case for the curvature radius 7*r* (1.5 cm) of the portion 7 having the smallest curvature radius and the curvature radius 8*r* (70 cm) of the portion 8 having the largest curvature radius at an opening 3 of the garment 1 illustrated in FIG. 2 through which an arm is passed will be described, in which dotted adhesives 11 each having a diameter of 1 mm are applied at spacings of 2 mm in a single row so as to extend along a position at 1 mm from the edge 13 of the fabric, and the fabric edge is folded back in a width of 3 mm and fastened. In this case, the average of spacings between adjacent dotted adhesives 11 in the 3-cm section of the portion 7 having the smallest curvature radius after the folding back and fastening is 2.62 mm, and that of the portion 8 having the largest curvature radius is 2.01 mm. Thus, the difference therebetween is about 30.3%, which causes a difference in adhesive strength due to the difference in curvature radius, and there is a risk that peeling-off may occur and also the appearance becomes unnatural. In order to make the adhesive strength uniform, the spacing between adhesives 11 to be applied to the fabric edge needs to be changed in advance in accordance with the curvature radius thereof. For example, when the average of spacings between the dotted adhesives 11 applied to the portion 7 having a smaller curvature radius is set to 1.70 mm, the average of dot spacings after folding back and fastening becomes 2.22 mm, and thus the difference therebetween can be reduced to 10.4%. By this setting, the adhesive strength per unit width at the opening 3 in which the curvature of the concave shape changes can be made substantially uniform, and also the appearance can be improved. When a portion having a curvature radius that is intermediate between the portion 7 having the smallest curvature radius and the portion 8 having the largest curvature radius is present, it is necessary to change the spacing between adhesives 11 to be applied to the fabric edge of the portion having the intermediate curvature radius such that also the difference between the average of spacings between adjacent dotted adhesives 11 in the 3-cm section of the portion 8 having the largest curvature radius and the average of spacings between adjacent dotted adhesives 11 in the 3-cm section of the portion having the intermediate curvature radius is within 15%.

Furthermore, for example, a case for the curvature radius 9*r* (13 cm) of the portion 9 having the smallest curvature radius and the curvature radius 10*r* (70 cm) of the portion 10 having the largest curvature radius at the opening 4 of the garment 1 illustrated in FIG. 2 through which the torso is passed will be described, in which dotted adhesives 11 each having a diameter of 1 mm are applied at spacings of 2 mm in a single row so as to extend along a position at 1 mm from the edge 13 of the fabric, and the fabric edge is folded back in a width of 15 mm and fastened. In this case, the average of spacings between adjacent dotted adhesives 11 in the 3-cm section of the portion 9 having the smallest curvature radius after the folding back and fastening is 2.48 mm, and that of the portion 10 having the largest curvature radius is 2.08 mm. Thus, the difference therebetween is about 19.2%, which causes a difference in adhesive strength due to the difference in curvature radius, and there is a risk that peeling-off may occur and also the appearance may become poor. In order to make the adhesive strength uniform, the dot spacing needs to be changed in advance in accordance with the curvature radius thereof. For example, when the average of spacings between dotted adhesives 11 applied to the portion 9 having the smallest curvature radius is set to 1.90 mm, the average of dot spacings after the folding back and fastening becomes 2.36 mm, and thus the difference therebetween can be reduced to 13.5%. By this setting, the adhesive strength per unit width at the opening 4 in which the curvature of the concave shape changes can be made substantially uniform, and also the poor appearance can be mitigated. When a portion having a curvature radius that is intermediate between the portion 9 having the smallest curvature radius and the portion 10 having the largest curvature radius is present, it is necessary to change the spacing between adhesives 11 to be applied to the fabric edge of the portion having the intermediate curvature radius such that also the difference between the average of spacings between adjacent dotted adhesives 11 in the 3-cm section of the portion 10 having the largest curvature radius and the average of spacings between adjacent dotted adhesives 11 in the 3-cm section of the portion having the intermediate curvature radius is within 15%.

Furthermore, for example, a case for the curvature radius 5*r* (2 cm) of the portion 5 having the smallest curvature radius and the curvature radius 6*r* (60 cm) of the portion 6 having the largest curvature radius at the opening 2 of the garment 1 illustrated in FIG. 2 through which the head is passed will be described, in which dotted adhesives 11 each having a diameter of 1 mm are applied at spacings of 2 mm in a single row so as to extend along a position at 1 mm from the edge 13 of the fabric, and the fabric edge is folded back in a width of 5 mm and fastened. In this case, the average of spacings between adjacent dotted adhesives 11 in the 3-cm section of the portion 5 having the smallest curvature radius after the folding back and fastening is 3.00 mm, and that of the portion 6 having the largest curvature radius is 2.03 mm. Thus, the difference therebetween is about 47.8%, which causes a difference in adhesive strength due to the difference in curvature radius, and there is a risk that peeling-off may occur and also the appearance may become poor. In order to make the adhesive strength uniform, the dot spacing needs to be changed in advance in accordance with the curvature radius thereof. For example, when the average of spacings between dotted adhesives 11 applied to the portion 5 having the smallest curvature radius is set to 1.50 mm, the average of dot spacings after the folding back and fastening becomes 2.25 mm, and thus the difference therebetween can be reduced to 10.8%. By this setting, the adhesive strength per unit width at the opening 2 in which the curvature of the concave shape changes can be made substantially uniform, and also the poor appearance can be mitigated. When a portion having a curvature radius that is intermediate between the portion 5 having the smallest curvature radius and the portion 6 having the largest curvature radius is present, it is necessary to change the spacing between adhesives 11 to be applied to the fabric edge of the portion having the intermediate curvature radius such that also the difference between the average of spacings between adjacent dotted adhesives 11 in the 3-cm section of the portion 5 having the largest curvature radius and the average of spacings between adjacent dotted adhesives 11 in the 3-cm section of the portion having the intermediate curvature radius is within 15%.

Values obtained by calculation of the difference between the averages of spacings of adhesives described above include positive ones and also negative ones. For example, when a plurality of arbitrary values as averages ds of spacings between adhesives in portions having smaller curvature radii exist with fluctuations on both sides of the positive side and the negative side, the relative difference between the averages of spacings of adhesives can be considered to increase. In such a case, it is preferable that the difference between the averages of spacings of adhesives in both the portions be within 151 from the spacing db between adhesives in the portion having the largest curvature radius.

A resin of which the adhesives 11 are made is preferably a synthetic resin rather than a natural resin, and more preferably a thermoplastic resin thereof. For example, in addition to polyethylene, polypropylene, polyvinyl chloride, polystyrene, polyvinyl acetate, polyurethane, polytetrafluoroethylene, polyacryl, polyamide, polyacetal, polycarbonate, polyphenylene ether, polyester, polyphenylene sulfide, polysulfone, polyether sulfone, polyether ether ketone, polyimide, and polyamide imide, various types of resins that are not limited to particular ones may be used if they are made of high molecular compounds.

As a preferable hardness of the resin of which the adhesives 11 are made, the durometer D hardness measured according to the testing methods for durometer hardness of plastics described in "JIS K 7215 1986" is 10 to 90, and more preferably 10 to 60.

As a preferable relative density of the resin of which the adhesives 11 are made, the relative density measured according to the method of measuring the relative density of plastics described in "JIS K 7112 1999" is 1.00 to 1.30, and more preferably 1.10 to 1.20.

The resin of which the adhesives 11 are made is preferably a reactive hot-melt one. When the resin is a reactive hot-melt one, the resin is softened or dissolved to be impregnated into the structure of the part to be bonded, and after being cooled and solidified, the resin reacts with surrounding moisture, whereby the cross-linking proceeds and a bonded structure having excellent heat resistance and excellent solvent resistance can be formed.

The suitable size of dotted adhesives 11 differs depending on the composition and the thickness of a fabric that forms the garment 1. Although a dot having a diameter of about 1.0 to 2.0 mm can easily have a relatively high adhesive strength, such dotted adhesives may seep through a fabric to the outer side thereof and may become conspicuous when the fabric is thin, which may impair the appearance. Thus, the dot is preferably smaller within a range in which required adhesive strength can be obtained. The diameter thereof is preferably 1.0 mm or smaller because such adhesives are less likely to seep even when the fabric is for an inner wear having a fabric thickness of about 0.5 to 0.8 mm. Furthermore, the diameter is preferably 0.6 mm or smaller because seepage of such adhesives are less likely to be conspicuous even when the fabric is still thinner so as to have a fabric thickness of about 0.3 to 0.5 mm. When the diameter of adhesives 11 is smaller and the adhesive strength decreases accordingly, the adhesives 11 can be reinforced by reducing the spacing therebetween. Herein, the diameter of the adhesives 11 means a length in a planar direction. The height of adhesives 11 is substantially the same as the diameter thereof when applied to a fabric edge, but does not affect the thickness of the garment 1 because the adhesives 11 permeate into the fabric once being fastened.

The folded width of the fabric edge is preferably 2 to 25 mm. When the fabric edge that has been folded back is fastened with the dotted adhesives 11, it can be fastened even by folding back in a very thin width in comparison with fastening by machine sewing. Because the folded width is thin, even a fabric edge having a small curvature radius can be easily folded back. The folded width is preferably 2 to 10 mm.

Figure 4:
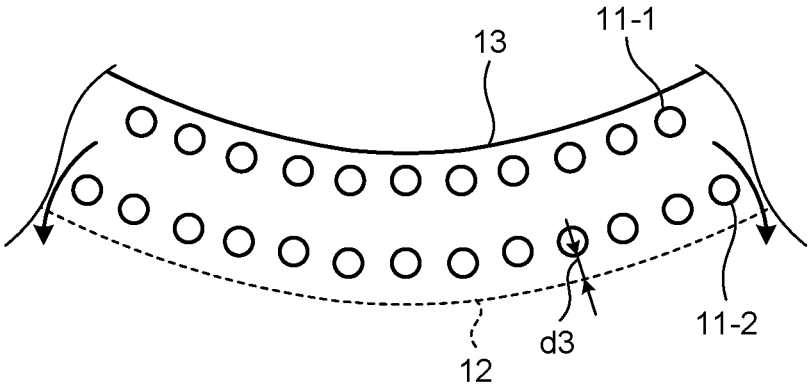
FIG. 4 includes diagrams schematically illustrating states in which adhesives are applied at an opening of the garment illustrated in FIG. 1.
Figure 4:
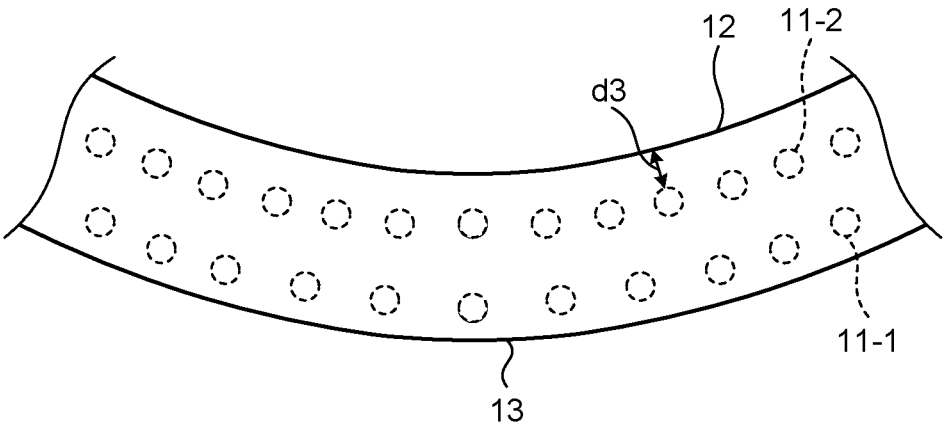

FIG. 4(*a*) is a diagram illustrating one example of a positional relation between a fabric edge of an opening of the garment 1 and adhesives applied thereto in multiple rows. FIG. 4(*b*) is a diagram illustrating a positional relation between the fabric edge and the adhesives when the fabric edge has been folded back along a fold line at the opening of FIG. 4(*a*). In the example of FIG. 4(*a*), dotted adhesives 11-1 and 11-2 are arranged in two rows along the edge 13 of the fabric in a pattern curved in a concave shape. As illustrated in FIG. 4(*b*), it is important that the distance d3 between the adhesives 11-2 forming a row that is the closest to the opening, i.e., the fold line 12, and the fold line 12 is 0.5 mm or more. Patent Literature 1 described above describes that, when an outer fabric for a hem of a swimsuit, for example, is folded back, it is folded back along a hot-melt sheet that has been bonded. However, when this technique is applied to the garment according to the present invention (the folding position at the opening and the row of the adhesives are adjacent to each other), pressure marks of the dotted adhesives that are applied repeatedly appear when the folded edge at the opening is stretched, whereby projections and depressions are formed on an edge of the opening and the appearance becomes poor. In view of this, in the garment 1 according to the present invention, the adhesives 11-2 forming a row closest to the opening, i.e., the fold line 12, is preferably applied at a spacing of 0.5 mm or more away from the position of the fold line 12 as the edge of the opening. More preferably, they are applied at a spacing of 1.0 mm or more away therefrom. Although a case in which the adhesives 11-1 and 11-2 are arranged in two rows is illustrated in FIG. 4, even when being applied in one row, the adhesives 11 are preferably applied at a spacing of 0.5 mm or more away from the fold line 12. Even when the adhesives are applied in three or more rows, the row of the adhesives to be applied closest to the fold line is preferably applied at a spacing of 0.5 mm or more away from the fold line.

Although the adhesives 11 applied in a dot pattern have the shape of a circle in the first embodiment, the shape is not limited to this. In order to enable the spacing between adhesives 11 to be changed, shapes that allow the adhesives 11 to be repeatedly applied in a separated state only need to be used, linear shapes or geometric shapes may be used, and also shapes in combination therewith may be used.

Second Embodiment

Figure 5:
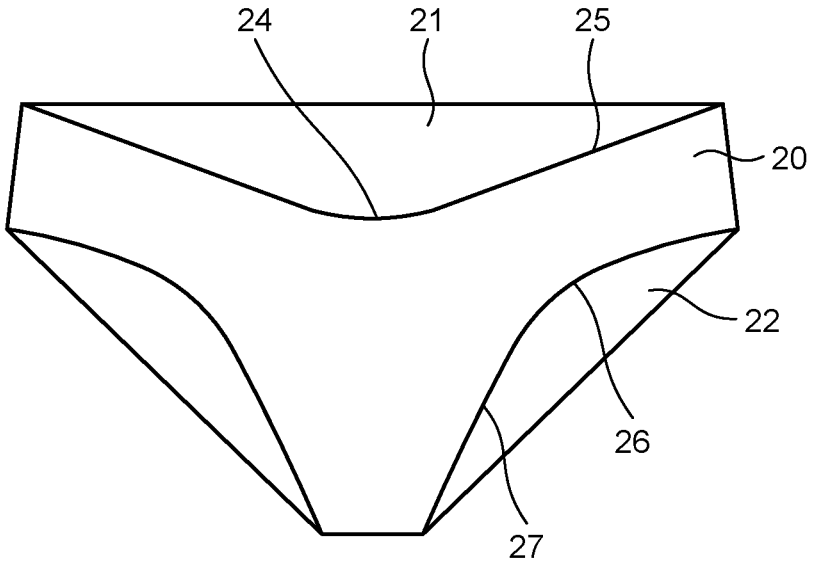
FIG. 5 is a diagram illustrating an appearance of a garment according to a second embodiment.

FIG. 5 is a diagram illustrating a configuration of a garment according to a second embodiment. The garment 20 illustrated in this diagram is one example of lower wear of underwear, and has openings 21 and 22 through which legs and the torso are passed. The openings 21 and 22 are formed in such patterns that their curvatures change, and respectively have portions 24 and 26 curved in a concave shape and having the smallest curvature radii and portions 25 and 27 curved in a concave shape and having the largest curvature radii. In the second embodiment also, it is needless to say that effects of the present invention can be obtained under the same concept as in the first embodiment.

Although the embodiments of the present invention have been described above, the present invention should not be limited to the above-described embodiments. For example, the same effects may be imparted to openings of garments such as hats and sleevelets.

EXAMPLES

Example 1

In Example 1, in a design for general underwear as illustrated in FIG. 2, at an opening 3 through which an arm was to be passed, the curvature radius 7*r* of the portion 7 having the smallest curvature radius was set to 1.5 cm, and the curvature radius 8*r* of the portion 8 having the largest curvature radius was set to 70 cm. As illustrated in FIG. 3, so as to extend along a position at 1 mm from the edge 13 of the fabric, dotted adhesives 11 each having a diameter of 1 mm were applied at spacings of 1.70 mm in a single row for the portion 7 having the smallest curvature radius, and was applied at the spacings of 2.00 mm in a single row for the portion 8 having the largest curvature radius. When the fabric edge had been folded back in a width of 3 mm and fastened, the average of spacings between adjacent dots in the 3-cm section of the portion 7 having the smallest curvature radius was 2.22 mm, and that of the portion 8 having the largest curvature radius was 2.01 mm. The difference therebetween was about 10.4%. The configuration and the appearance evaluation of Example 1 are given in Table 1.

TABLE 1

| | | Example 1 | Example 2 | Example 3 | Comparative Example 1 | Comparative Example 2 | Comparative Example 3 |
|---|---|---|---|---|---|---|---|
| Location | | Sleeve opening | Bottom opening | Collar opening | Sleeve opening | Bottom opening | Collar opening |
| Smallest curvature radius | cm | 1.5 | 13 | 2 | 1.5 | 13 | 2 |
| Largest curvature radius | cm | 70 | 70 | 60 | 70 | 70 | 60 |
| Folded width of fabric edge | mm | 3 | 15 | 5 | 3 | 15 | 7 |
| The number of dot rows | row(s) | 1 | 2 | 1 | 1 | 2 | 1 |
| Distance(s) of the dot row(s) from the edge of the fabric edge | mm | 1 | 1 and 4 | 1 | 1 | 1 and 15 | 3 |
| Distance of the dot row from the fold line | mm | 1 | 11 | 4 | 1 | 0 | 4 |
| Spacing between dots applied to the fabric edge having the smallest curvature radius | mm | 1.7 | 1.9 | 1.5 | 2.0 | 2.0 | 2.0 |
| Spacing between dots applied to the fabric edge having the largest curvature radius | mm | 2.0 | 2.0 | 2.0 | 2.0 | 2.0 | 2.0 |
| Difference between averages of dot spacings | % | 10.4 | 13.5 | 10.8 | 30.3 | 19.2 | 47.8 |
| Appearance evaluation | | Good | Good | Good | Felt unnatural because dot spacings were not uniform | Pressure marks of dots appeared as projections and depressions when the opening was stretched and widened | The edge of the folded-back fabric edge was pulled to be stood up and felt unnatural. |

Example 2

In Example 2, in the same underwear design as in Example 1, at the opening 4 through which the torso was to be passed, the curvature radius 9*r* of the portion 9 having the smallest curvature radius was set to 13 cm, and the curvature radius 10*r* of the portion 10 having the largest curvature radius was set to 70 cm. As illustrated in FIG. 4, at positions at 1 mm and 4 mm from the edge 13 of the fabric, dotted adhesives 11-1 and 11-2 each having a diameter of 1 mm were applied at spacings of 1.90 mm in two rows for the portion 9 having the smallest curvature radius, and were applied at spacings of 2.00 mm for the portion 10 having the largest curvature radius. When the fabric edge had been folded back in a width of 15 mm and fastened, the average of spacings between adjacent adhesives 11-1 on the side closest to the fabric edge in the 3-cm section of the portion 9 having the smallest curvature radius was 2.36 mm, and that of the portion 10 having the largest curvature radius was 2.08 mm. The difference therebetween was 13.5%. The configuration and the appearance evaluation of Example 2 are given in Table 1.

Example 3

In Example 3, in the same underwear design as in Example 1, at the opening 2 through which the head was to be passed, the curvature radius 5*r* of the portion 5 having the smallest curvature radius was set to 2 cm, and the curvature radius 6*r* of the portion 6 having the largest curvature radius was set to 60 cm. As illustrated in FIG. 3, so as to extend along a position at 1 mm from the edge 13 of the fabric, dotted adhesives 11 each having a diameter of 1 mm were applied at spacings of 1.5 mm in a single row for the portion 5 having the smallest curvature radius, and were applied at spacings of 2.00 mm in a single row for the portion 6 having the largest curvature radius. When the fabric edge had been folded back in a width of 5 mm and fastened, the average of spacings between adjacent dots in the 3-cm section of the portion 5 having the smallest curvature radius was 2.25 mm, and that of the portion 6 having the largest curvature radius was 2.03 mm. The difference therebetween was about 10.8%. The configuration and the appearance evaluation of Example 3 are given in Table 1.

Comparative Example 1

Comparative Example 1 had the same configuration as in Example 1 except that the adhesives 11 were applied at spacings of 2.00 mm in a single row for both of the portion 7 having the smallest curvature radius and the portion 8 having the largest one. After the folding back and fastening, the average of spacings between adjacent dots in the 3-cm section of the portion 7 having the smallest curvature radius was 2.62 mm, that of the portion 8 having the largest curvature radius was 2.01 mm, and the difference therebetween was 30.3%. The configuration and the appearance evaluation of Comparative Example 1 are given in Table 1.

Comparative Example 2

Comparative Example 2 had the same configuration as in Example 2 except that the adhesives 11-1 and 11-2 were applied at spacings of 2.00 mm in two rows at positions at 1 mm and 15 mm from the edge 13 of the fabric edge for both of the portion 9 having the smallest curvature radius and the portion 10 having the largest one. When the fabric edge had been folded back in a width of 15 mm along the positions of the dotted adhesives, the average of spacings between adjacent adhesives 11-1 on the side closest to the fabric edge in the 3-cm section of the portion 9 having the smallest curvature radius was 2.48 mm, that of the portion 10 having the largest curvature radius was 2.08 mm, and the difference therebetween was 19.2%. At this time, the position of the adhesives 11-2 on the side closest to the fold line was the same as the position of the fold line, and thus there was no spacing between the positions of the fold line and the adhesives. The configuration and the appearance evaluation of Comparative Example 2 are given in Table 1.

Comparative Example 3

Comparative Example 3 had the same configuration as in Example 3 except that the adhesives 11 were applied at spacings of 2.00 mm in a single row at a position at 3 mm from the edge 13 of the fabric edge for both of the portion 5 having the smallest curvature radius and the portion 6 having the largest one and the fabric edge was folded back in a width of 7 mm and fastened. After the fastening, the average of spacings between adjacent dots in the 3-cm section of the portion 5 having the smallest curvature radius was 3.00 mm, that of the portion 6 having the largest curvature radius was 2.03 mm, and the difference therebetween was 47.8%. The configuration and the appearance evaluation of Comparative Example 3 are given 1.

REFERENCE SIGNS LIST

1 garment
2 opening through which the head is passed
3 opening through which an arm is passed
4 opening through which the torso is passed
5, 7, 9, 24, 26 portion having the smallest curvature radius
6, 8, 10, 25, 27 portion having the largest curvature radius
11, 11-1, 11-2 adhesive
12 fold line
13 edge of a fabric
20 garment
21 opening through which the torso is passed
22 opening through which a leg is passed

The invention claimed is:

1. A garment made of a stretchable fabric and having an opening through which a body part of a wearer is passed, wherein the opening has a folded structure in which a fabric edge is folded back, stretched and fastened to a main body of the fabric along a fold line with dotted adhesives in a single row or multiple rows along the folded fabric edge and along the main body within the folded structure wherein an average distance between adjacent adhesives in a row in a three-centimeter section of a portion of the folded fabric edge increases after the fabric edge is folded back, stretched and fastened to the main body, a part of the folded structure of the opening is formed with a pattern in which a curvature of the opening changes, and the single row or a row of the multiple rows of adhesives along the folded fabric edge of the folded structure is disposed within 2 mm from the edge of the fabric, a difference of within 15% exists between an average distance between adjacent adhesives in a row in a three-centimeter section of the main body having the largest curvature radius in the folded structure of the opening and the average distance between adjacent adhesives in a row in a three-centimeter section of the folded fabric edge which previously had a smaller curvature radius before it was folded in the folded structure of the opening, the row of the adhesives on a side closest to the fold line is spaced from the fold line by 0.5 mm or more, each of the dotted adhesives has a diameter of 1.0 to 2.0 mm when the fabric has a thickness of 0.8 mm or more, each of the dotted adhesives has a diameter of 0.6 to 1.0 mm when the fabric has a thickness of 0.5 to 0.8 mm, and each of the dotted adhesives has a diameter of 0.6 mm or less when the fabric has a thickness of 0.3 to 0.5 mm.

2. The garment according to claim 1, wherein a folded width of the fabric edge is 2 to 25 mm.

3. The garment according to claim 1, wherein the adhesives are a reactive hot-melt adhesive.

4. The garment according to claim 1, wherein the adhesives are made of resin having a durometer D hardness of 10 to 90, the durometer D hardness being measured according to a testing method for durometer hardness of plastics in JIS K 7215 1986.

5. The garment according to claim 1, wherein the adhesives are made of resin having a relative density of 1.00 to 1.30, the relative density being measured according to a measuring method for relative density of plastics in JIS K 7112 1999.

* * * * *